United States Patent [19]

Poncy

[11] Patent Number: 4,609,123

[45] Date of Patent: Sep. 2, 1986

[54] BEVERAGE CAN WITH SANITARY RECLOSABLE LID

[76] Inventor: George W. Poncy, 3725 Investment La., Riviera Beach, Fla. 33404

[21] Appl. No.: 784,746

[22] Filed: Oct. 7, 1985

[51] Int. Cl.[4] ..... B65D 51/22; B65D 43/16

[52] U.S. Cl. ..... 220/258; 220/269; 220/270; 220/259

[58] Field of Search ..... 220/258, 259, 256, 260, 220/269, 270; 229/7 R

[56] References Cited

U.S. PATENT DOCUMENTS

| | | | |
|---|---|---|---|
| 4,077,538 | 3/1978 | Waterbury | 220/268 |
| 4,083,471 | 4/1978 | Frank | 220/269 |
| 4,203,528 | 5/1980 | Hasegawa | 220/269 |
| 4,267,937 | 5/1981 | Piltz et al. | 220/269 |
| 4,397,403 | 8/1983 | Guimarin | 220/269 |
| 4,473,168 | 9/1984 | Cox | 220/259 |
| 4,562,936 | 1/1986 | Deflander | 220/258 |

*Primary Examiner*—George T. Hall

*Attorney, Agent, or Firm*—Lane and Aitken

[57] ABSTRACT

A beverage can is provided with an improved sanitary reclosable lid assembly comprising a top disk and a bottom disk both attached to the side walls of the can. An aperture is provided in the bottom disk and the top disk is provided with structure in the form of a depression or a stopper to close the aperture. A tear score line is defined in the top disk to define a flap including the closure structure. A pull-ring is attached to the flap to pull back the flap to open the aperture in the lower disk. The flap can then be replaced in its original position to reclose the aperture.

12 Claims, 17 Drawing Figures

BEVERAGE CAN WITH SANITARY RECLOSABLE LID

BACKGROUND OF THE INVENTION

This invention relates to a beverage type container and more particularly, to an improved lid for beverage type containers such as are employed to contain soft drinks and beer and which are opened by means of a pull-ring to tear away a tab or flap portion to enable the contents of the can to be poured out.

When the pull-ring type can opener was first developed for beverage cans, it proved to be objectionable because the pull-ring and an attached tab torn from the lid was completely removed from the can when the can was opened. This created a litter problem, and on occasion the ring and tab assembly would be inserted into the can before the contents of the can was consumed, creating the possibility that the ring and tab assembly might be inadvertently swallowed when the contents of the can was being consumed. To overcome this problem, the pull-ring design was modified so that the pull-ring remained attached as part of the lid after the can was opened. This design change eliminated the problems of the removable pull-ring and tab, but it has raised another problem. In the design commonly used, when the pull-ring is pulled, the tab upon being torn open is depressed into the can so that the tab itself is washed by the contents of the can as it is poured out. Thus, the contents of the drink can become contaminated by dirt and bacteria deposited on the exposed tab before it is opened.

SUMMARY OF THE INVENTION

The present invention provides a beverage can lid design employing a pull-ring to open the can which avoids the above described problems and at the same time maintains the pull ring assembly permanently attached to the can lid. In addition to overcoming the above described problems, the can lid design of the present invention also provides for the can to be closed and resealed so as to preserve the freshness and any carbination of the contents of the container when it is only partially consumed.

In accordance with the invention, the beverage can lid comprises two disks making up the top lid of the can. The bottom disk is formed with an aperture for pouring out the contents out of the can. The top disc is provided with a portion which fits into the aperture in the bottom disk to close it. A tear score line is provided in the top disk incompletely surrounding the depression to define a flap, to which a pull-ring is attached so that the flap can be torn from the remainder of the top disc to open the can. The score line defines on one side of the top disk a hinge on which the flap is bent away from the top of the can but maintaining the flap, with the attached pull-ring, permanently attached to the can. To reseal the can, the flap is simply bent back in place and the closure portion will reseat itself in the aperture in the lower disk. The lower disk is provided with a depression beneath a rivet by which the pull-ring is attached to the flap so that when the pull ring is first pulled up from the can, tearing of the flap from the remainder of the top disk can be initiated by depression of the flap into the depression in the lower disk.

Accordingly, an object of the present invention is to provide an improved beverage can lid.

A further object of the invention is to provide a beverage can lid which is more sanitary to use than the can lids of the prior art.

A further object of the present invention is to provide an improved beverage can lid of the pull-ring opening type which is reclosable and resealable.

A still further object of the present invention is to provide a beverage can top of the pull-ring type in which the pull ring assembly is a permanently attached to the can, but which does not come in contact with the beverage when the beverage is poured out.

Further objects and advantages of the invention will become readily apparent as the following detailed description of the invention unfolds when taken in conjunction with the drawings.

DESCRIPTION OF THE PREFERRED EMBODIMENTS

Figure 1:
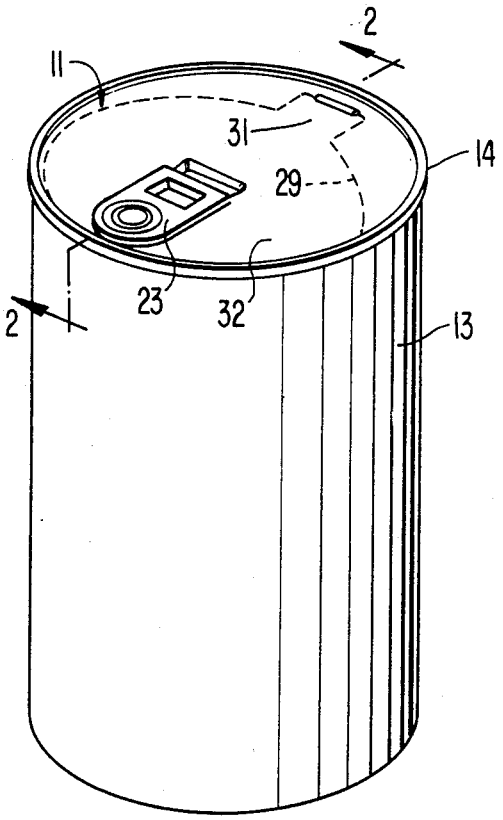
FIG. 1 is a perspective view of a beverage can in accordance with the present invention.
Figure 3:
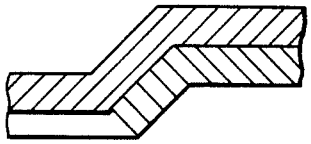
FIG. 3 is an enlarged view of a portion of FIG. 2 within the circle 3.
Figure 2:
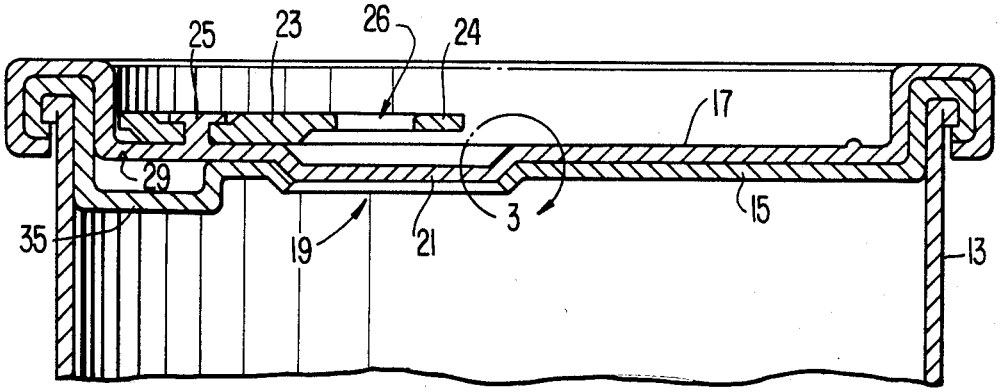
FIG. 2 is a sectional view of the beverage can of FIG. 1 taken along the line 2—2.
Figure 4:
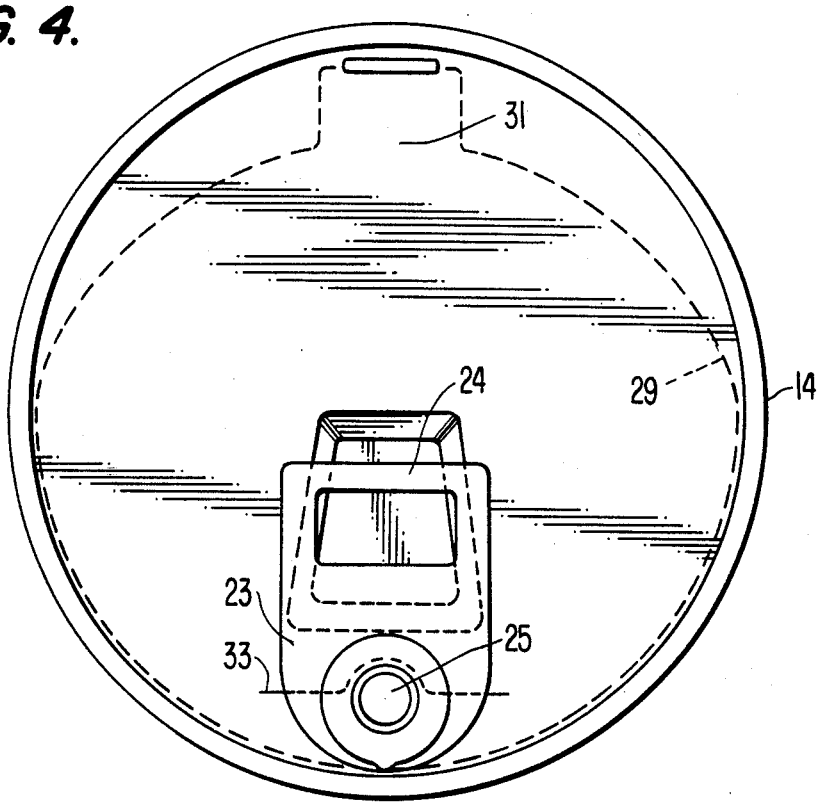
FIG. 4 is a top plan view of the beverage can of FIG. 1.
Figure 5:
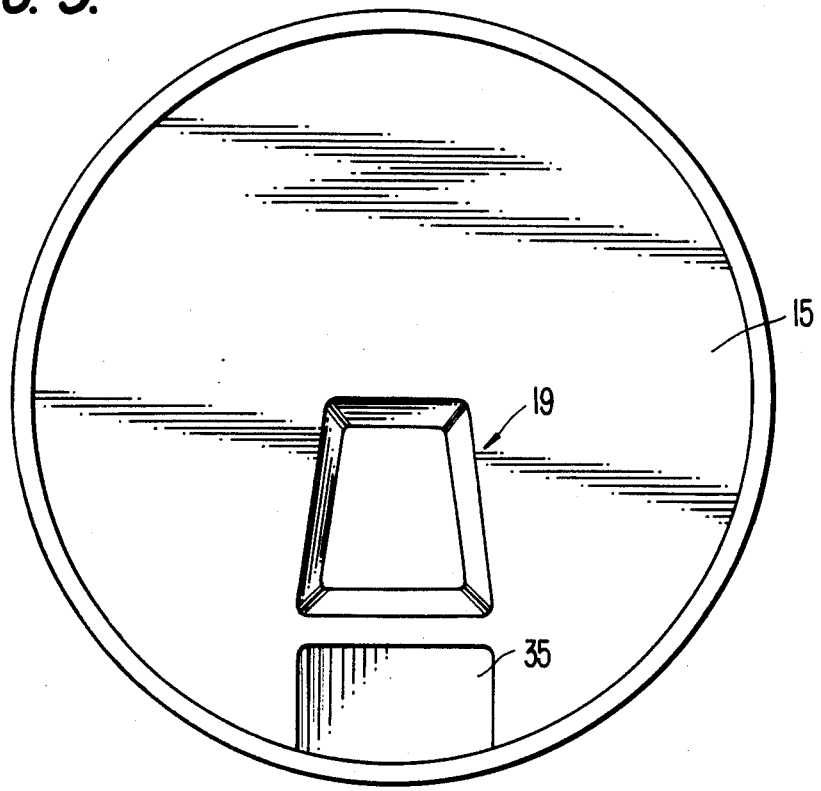
FIG. 5 is a top plan view of the beverage can of FIG. 1 with the upper disk of the lid assembly of the beverage can removed.

As shown in FIGS. 1–5, the invention comprises a lid assembly 11 for a soft drink can 13 of the type usually made from aluminum. The lid assembly comprises a bottom disk 15 and a top disk 17, both secured to the side walls of the can body 13 at the rim 14 of the lid assembly 11 in the conventional manner by crimping so that the lid assembly 11 forms a sealed enclosure for the contents contained in the can body 13. The bottom disk 15 is formed with a pouring aperture 19 extending from a point near the middle of the disk to a point about one quarter of the way to the edge of the disk. The aperture 19 is shown as trapezoidal, but it may be round, square, triangular, or any desired shape as long as it is large enough to conveniently pour liquid through. The top disk 19 has a depression 21 aligned with and corresponding in shape with the aperture 19, and and extending into the aperture 19. As best shown in the enlarged sectional view of FIG. 3, the edge defining the aperture 19 is bent slightly downward and the edges of the depression 21 are tapered or bevelled to mate with the downwardly bent edges of the aperture 19. This downward bending occurs naturally by making the aperture 19 slightly smaller than the area of the depression 21 measured at its upper edge so that when the upper disk 17 is mated with the lower disk 15, the depression 21 is forced into the aperture 19 and bends the edges of the aperture 19 slightly downwardly as shown in FIG. 3. Mounted on the top disk 17 is a handle in the form of a conventional pull-ring 23. A rivet 25 located about midway between the depression 21 and the rim 14 of the can lid fixes the pull-ring 23 to the disk 17. A tear score line 29 is provided in the top disk 17 shaped in a large semicircular configuration just inside the rim 14 on the side where the pull-ring 23 is attached to the disk 17. The pull-ring 23 comprises a flat strip of aluminum extending parallel to the top disk 17 toward the center of the can, and terminating in a distal end 24 over the depression 21. An aperture 26 is defined in the flat strip of the pull-ring 23 near the distal end 24 so that the strip of metal between the distal end of the pull-ring and the aperture bridges the depression 21. This structure facilitates grasping the pull-ring to initiate opening. On the opposite side of the disk 17, the tear score line 29 extends inwardly from the rim 14 and then turns back toward the rim 14 in two parallel lines ending at the rim so as to define a hinge 31 between the rim of the upper disk and an approximately circular flap 32 defined within the circular portion of the tear scoreline 29. Another scoreline 33 in the shape of an eyebrow is defined extending in a semicircle around the rivet 25 between the rivet 25 and the depression 21 and extending in straight lines away from the rivet on opposite sides thereof perpendicular to a radius extending from the center of the disk assembly 11 through the rivet 25. The eyebrow shaped scoreline 33 is to facilitate bending of the upper disk 17 at the line 33 when the pull-ring 23 is pulled upwardly to begin opening the can. The lower disk 15 is formed with a depression 35 extending from the rim 14 to a point inside the rivet 25 leaving a hollow space or recess 36 between the depression 35 and the upper disk 17. The tear scoreline 29 passes over the recess 36. When the end of the pull-ring 23 opposite the rivet 25 is lifted to begin opening the can, the initial tear in the tear scoreline 29 will occur over the recess 36 by bending of the material of the upper disk 17 inside the scoreline 29 downwardly into the recess 36. The purpose of the depression 35 is to permit this downward bending to occur at the start of the opening operation. After the initial tear has been started by the upward pulling on the pull-ring 23, continued tugging on the pull-ring will pull the flap 32 upwardly away from the rim 14, removing the depression 21 from the aperture 19, until the tear in the scoreline 29 reaches the hinge 31. At this point, the material of the upper disk 17 can be easily bent within the hinge 31, conveniently out of the way, so that the contents of the can can be poured from the aperture 19.

Because the lower disk 15 containing the aperture 19 is completely covered by the upper disk, the consumer can drink the contents from the can by placing his lips directly on the lower disk, secure in the knowledge that his lips are touching a clean surface and the contents of the can, while being poured out through the aperture 19, touches nothing but the edges of the aperture 19 which have been kept clean by being covered by the upper disk 17. To reseal the can, the flap 32 is bent back on the hinge 31 to its original position over the lower disk 15 and the depression 21 is pushed back into the aperture 19 by the thumb of the consumer to thus, reseal the can and preserve the freshness and any carbonation in the portion of the beverage remaining in the can. Preferrably, the bevelled edge of the depression 21, the edge of the aperture 19 which engages the bevelled of the depression 21, or both, are coated with an elastomeric material to facilitate sealing of the aperture 19 with the depression 21.

Figure 6:
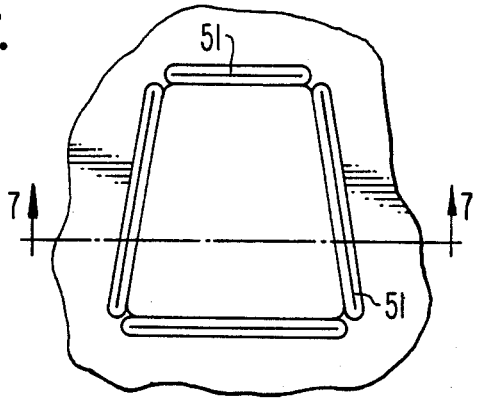
FIG. 6 illustrates a plan view of the pouring aperture of the lower disk of the lid assembly for a beverage can in accordance with an alternative embodiment.
Figure 7:
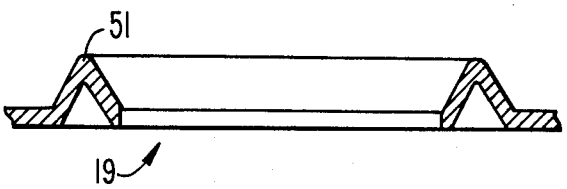
FIG. 7 is a sectional view taken along the line 7—7 of FIG. 6.
Figure 8:
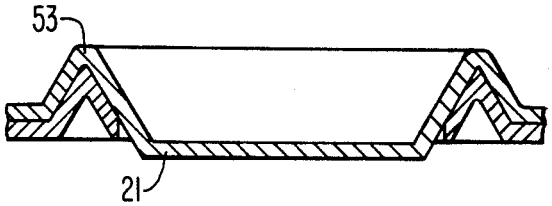
FIG. 8 is a sectional view corresponding to FIG. 7 with the lower disk and the upper disk of the beverage can lid assembly assembled together.

In the modification of the invention illustrated in FIGS. 6–8, the aperture 19 in the lower disk 15 is reinforced by ribs 51, which extend along the perimeter of the aperture 19. The purpose of the ribs 51 is to impart rigidity to the lower disk so that when the consumer reseals the container by pressing the depression 21 of the upper disk back into the aperture 19, the ribs will help the lower disk resist bending inwardly. In addition, the ribs reduce flexing of the lower disk outwardly when the can is opened by the flap 32 being pulled upwardly removing the depression 21 from the aperture 19. As shown in FIG. 8, the upper disk is also formed into upwardly extending ribs 53 at the edge of the depression 21 to mate with the ribs 51. The tapered edges of the depression 21 in this embodiment conveniently comprise an extension of the inner edges of the ribs 53.

Figure 9:
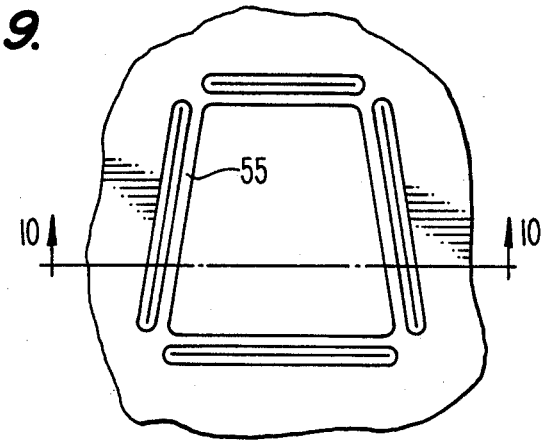
FIG. 9 is a plan view of a pouring aperture in the lower disk of the lid assembly in accordance with another embodiment of the invention.
Figure 10:
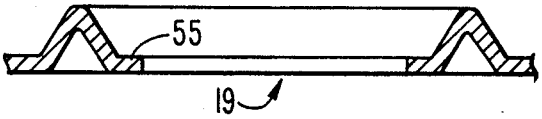
FIG. 10 is a sectional view taken along the line 10—10 of FIG. 9.
Figure 11:
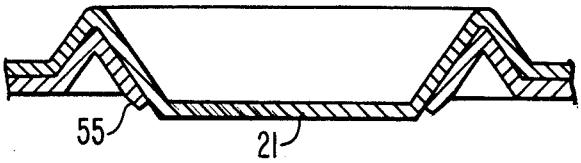
FIG. 11 is a sectional view corresponding to FIG. 10, but with the upper and lower disks of the lid assembly assembled together.
Figure 12:
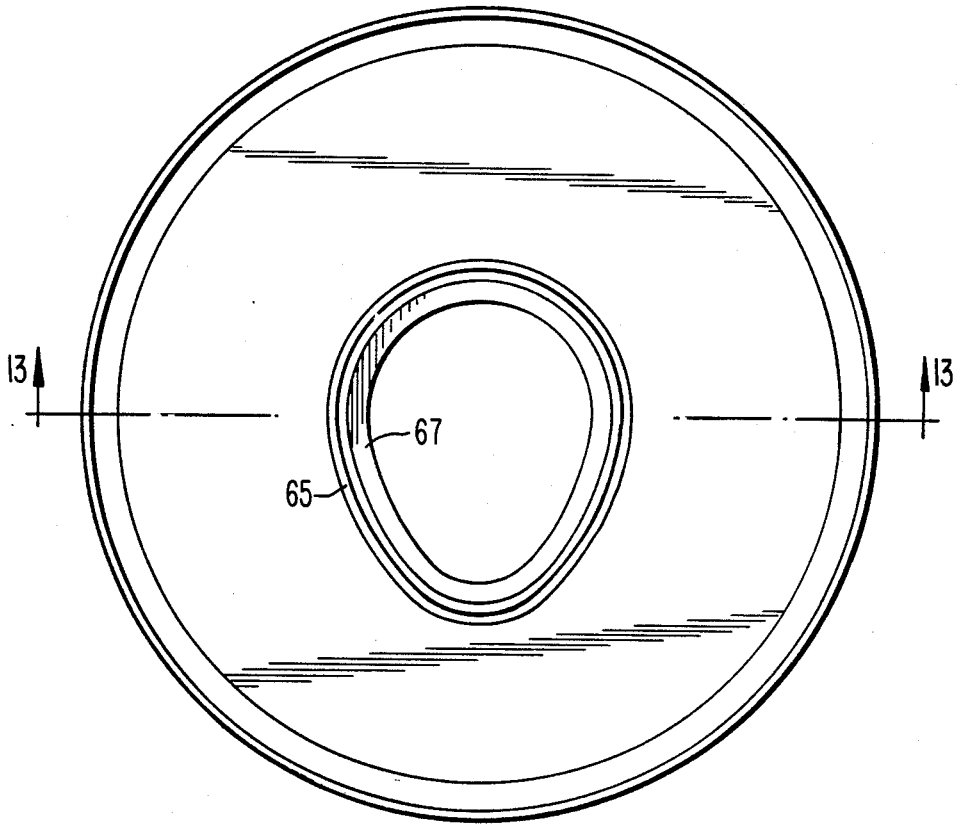
FIG. 12 is a top plan view of the lower disk of lid assembly in accordance with another embodiment of an invention.
Figure 13:
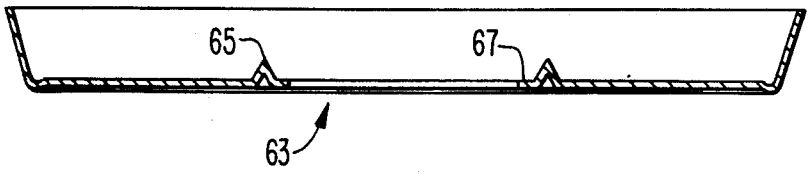
FIG. 13 is a sectional view of FIG. 12 taken along the line 13—13.

Instead of having the ribs 51 located right at the edge of the aperture, the ribs can be spaced from the edge of the aperture 19 slightly to leave a lip 55 as shown in the embodiment of FIGS. 9–11. In this embodiment, when the upper disk is mated with the lower disk, the lip 55 is flexed downwardly by the tapered edges of the depression 21, so as to provide a tight fit between the defected lip and the tapered edge of the depression.

Figure 14:
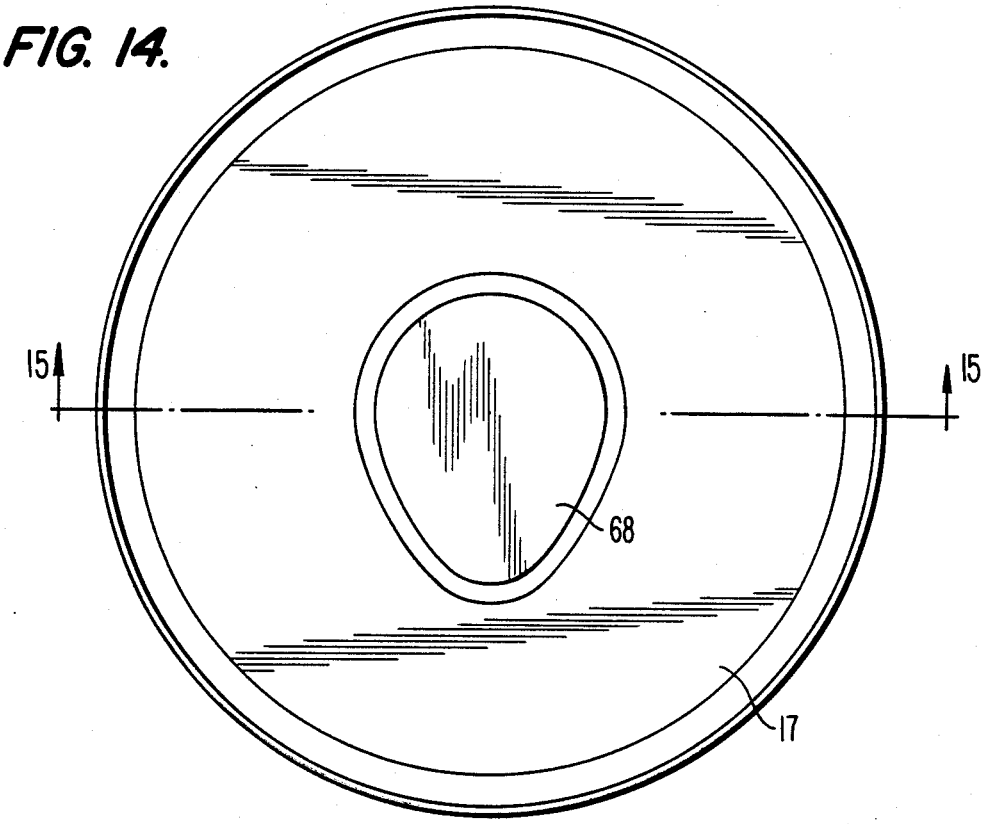
FIG. 14 is a top plan view of the upper disk of the lid assembly for the same embodiment as in FIG. 12.
Figure 15:
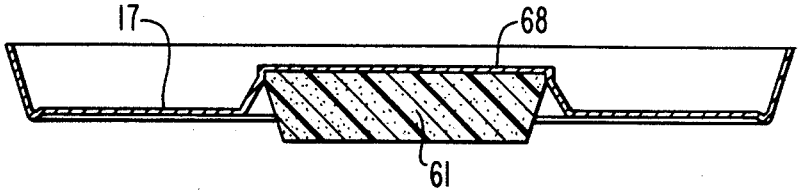
FIG. 15 is a sectional view taken along the line 15—15 of FIG. 14.
Figure 16:
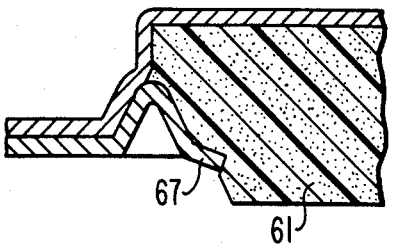
FIG. 16 is an enlarged partial sectional view showing the upper disk and lower disk of the lid assembly of FIGS. 12–15, assembled together.

In the embodiment shown in FIGS. 12–16 the closure for the aperture in the lower disk 15, instead of being formed by depression in the upper disk 17, is formed by an elastomeric stopper 61, which is cemented to the under side of the upper disk 17 as shown in FIG. 15. The upper disk 17 in this embodiment is provided with a pull-ring and score lines in the same manner as in the embodiment of FIG. 1, but these features have been omitted from the illustration of this embodiment for purposes of simplification. The aperture in the lower disk 15 is defined as an oval 63 and a strengthening rib 65 is provided around the aperture 63, spaced from the edge thereof slightly to define a lip 67 as in the embodiment of FIGS. 9–11. As shown in FIGS. 14 and 15, the upper disk 17 is provided with a raised area 68 to define a downwardly facing recess directly over the aperture 63 and the stopper 61 is cemented into this recess. The edges of the stopper are tapered so that when the upper disk is assembled with the lower disk, the stopper 61 deflects the lip 67 downwardly as shown in FIG. 16. Then when the container is to be resealed and the stopper is forced into the aperture, the deflected lip will press against the tapered edge of the stopper providing a tight fit against the bevelled edge of the stopper.

Figure 17:
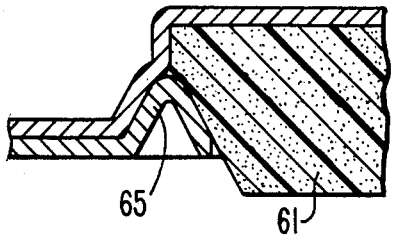
FIG. 17 is an enlarged sectional view corresponding to FIG. 16, but slightly modified.

The rib 65 instead of being spaced from the edge of the aperture 63 to leave the lip 67, may be located right at the edge of the aperture as shown in FIG. 17, in which case the taper in the inside edge of the rib 65 is relied upon to provide the tight sealing fit with the tapered edge of the stopper 61.

In the can of the invention, the flap which is pulled up from the upper disk 17 is permanently attached to the can body by means of a hinge. As a result an advantage of the prior art cans of avoiding littering from the pull ring assemblies is retained, while the disadvantage of a portion of the exposed top of the beverage can being depressed into the can to be washed by the contents thereof, when it is poured out, is avoided. Instead, a protected clean surface is provided around the pouring aperture after the can lid is opened. In addition, the invention provides a further advantage of permitting the can to be resealed to preserve the freshness and any carbonation in the contents of the can when only a portion of the contents has been consumed.

In the preferred embodiment, the lid assembly is made of the same material as the can side walls, such as aluminum. Alternatively, different materials may be used for some or all of the parts of the can. For example the top disk 17 could be made of a synthetic resin (plastic).

The above description is of a preferred embodiment of the invention and many modifications may be made thereto without departing from the spirit and scope of the invention, which is defined in the appended claims.

What is claimed is:

1. A can for containing a beverage comprising a can body having a side wall, a lid closing the top of said can, said lid comprising a lower disk and an upper disk, both joined to said side wall around the edge of said lid, said lower disk defining an aperture closed by said upper disk, said upper disk having a tear score line defined therein, said tear score line defining a flap in said upper disk covering said aperture, a handle attached to said flap, said handle comprising means to permit said flap to be pulled up from said aperture by tearing said upper disk along said tear score line.

2. A can as recited in claim 1, wherein said tear score line incompletely surrounds said handle to define a hinge in the material of said upper disk between the ends of said score line, said hinge bending as said flap is pulled up from said aperture while maintaining said flap attached to said can.

3. A can as recited in claim 2, wherein the ends of of said score line are located near the perimeter of said upper disk where it is joined to said side walls.

4. A can as recited in claim 1, wherein said upper disk has a portion coextensive with an extending into said aperture so as to comprise a plug operable to reclose said aperture after it has been opened.

5. A can as recited in claim 4, wherein said portion comprises a depression in the sheet material of said upper disk.

6. A can as recited in claim 5, wherein said handle comprises a flat strip extending parallel to said upper disk and attached at one end to said flap, an aperture defined through the other end of said handle opposite said one end, said handle and the aperture in said handle being shaped so that the portion of said handle between said aperture and said other end of said handle bridges said depression.

7. A can as recited in claim 4, wherein said portion comprises an elastomeric plug attached to the lower side of said upper disk.

8. A can as recited in claim 1 wherein said handle further comprises means to initiate tearing along said score line of said upper disk by depressing a portion of the edge of said flap beneath the remainder of said upper disk, said lower disk formed into a depression beneath said portion of the edge of said flap to define a recess to receive said portion of the edge of said flap when said last recited means initiates tearing of said score line.

9. A can as recited in claim 8, wherein said handle is attached to said flap near said portion of said edge and extends parallel to said upper disc into the middle of said flap, whereby the lifting of the end of said handle opposite to where said handle is attached to said flap operates to depress said portion of the edge of said flap.

10. A can as recited in claim 1, wherein upwardly extending ribs are formed in said lower disk surrounding said aperture.

11. A can as recited in claim 10, wherein said ribs are spaced from the edge of said aperture to define a lip surrounding said aperture between said ribs and said aperture.

12. A can as recited in claim 11, wherein said upper disk has a portion coextensive with and extending into said aperture so as to comprise a plug operable to reclose said aperture after it has been opened, said portion having a tapered periphery, said lip being deflected by said tapered periphery when said portion extends into and closes said aperture.

* * * * *